US006047791A

United States Patent [19]

Hoebelheinrich

[11] Patent Number: 6,047,791

[45] Date of Patent: Apr. 11, 2000

[54] VARIABLE COUNTERWEIGHT ARRANGEMENT FOR A FORKLIFT-TYPE VEHICLE

[75] Inventor: Dale R. Hoebelheinrich, Yankton, S. Dak.

[73] Assignee: Gehl Company, West Bend, Wis.

[21] Appl. No.: 09/046,067

[22] Filed: Mar. 23, 1998

[51] Int. Cl.[7] ..... B66F 9/06

[52] U.S. Cl. ..... 187/222; 280/759

[58] Field of Search ..... 187/222; 212/195, 212/196; 182/141; 280/759

[56] References Cited

U.S. PATENT DOCUMENTS

| | | | |
|---|---|---|---|
| 3,853,231 | 12/1974 | Luttrell | 280/759 |
| 4,664,404 | 5/1987 | Schultz | 280/759 |
| 5,462,309 | 10/1995 | Jeffers et al. | 212/195 |

OTHER PUBLICATIONS

"Dynalift Telescoping–Boom Forklifts", Brochure No. 3/94/20K, Gehl Company, 143 Water Street, West Bend, Wisconsin 53095–0179, 1994.

*Primary Examiner*—Kenneth W. Noland
*Attorney, Agent, or Firm*—Andrus, Sceales, Starke & Sawall

[57] ABSTRACT

A counterweight system for a lift-type vehicle, which includes a lifting arrangement for lifting a load at one end of the vehicle, includes a counterweight compartment located at an opposite end of the vehicle. The vehicle includes a set of ground-engaging wheels, and the lifting arrangement is located on one side of the set of wheels and the counterweight compartment is located on the other side of the set of wheels. The lifting arrangement includes a boom assembly mounted for pivoting movement between a pair of uprights located toward the same end of the vehicle as the counterweight compartment. The uprights are constructed to provide a first amount of counterweight to the vehicle, to provide a first lifting capacity for the vehicle. The counterweight compartment is located between the uprights, and one or two counterweights can be received within the counterweight compartment. Positioning a first counterweight within the counterweight compartment functions to provide an additional increment of counterweight to the vehicle to provide additional lifting capacity for the vehicle. Positioning a second counterweight in the counterweight compartment along with the first counterweight functions to increase the counterweight of the vehicle by an additional increment, to further increase the lifting capacity of the vehicle. A door is mounted adjacent the counterweight compartment, and is adapted to selectively enclose the counterweight compartment.

20 Claims, 2 Drawing Sheets

VARIABLE COUNTERWEIGHT ARRANGEMENT FOR A FORKLIFT-TYPE VEHICLE

BACKGROUND AND SUMMARY OF THE INVENTION

This invention relates to vehicles, and more particularly to a lift type vehicle incorporating a boom assembly and to a counterweight arrangement for the chassis of a vehicle to which the boom assembly is mounted.

Extendible boom forklift vehicles generally include a frame carrying ground-engaging wheels, and a motor and cab are mounted to the frame. A pair of spaced uprights are mounted to the frame toward the rear of the chassis, and a boom is pivotably mounted to the spaced uprights. A counterweight is mounted between the uprights toward the rear end of the chassis, and is operable to prevent tipping of the vehicle when a load is lifted by the boom assembly forwardly of the chassis.

In the past, a counterweight for this type of vehicle has been in the form of a weighted member mounted to the rear of the uprights. The weight of the weighted member varies according to the desired lifting capacity of the vehicle. For example, a heavier counterweight is mounted to the rear of the chassis to increase the lifting capacity of the vehicle. In the prior art, however, it has not been possible to provide sufficient counterweight for high capacity machines by mounting a counterweight member to the rear of the chassis. In order to provide additional counterweight for high capacity machines, the rear tires of the vehicle are filled with a calcium chloride solution to provide additional counterweight. While this functions well to provide the desired amount of counterweight, use of calcium chloride to fill the tires has been found to be less than an optimal solution.

In addition, the uprights in prior art forklifts of this type have been in the form of reinforced plate-like members, which provide adequate strength and support for the boom assembly and its associated components but which contribute little to counterweighting of the machine.

It is an object of the present invention to provide an improved counterweight arrangement for a lift type vehicle such as an extendible boom forklift. It is another object of the invention to utilize the uprights, to which the boom assembly is mounted and which are located at the rear of the vehicle, to provide counterweighting for the vehicle. Yet another object of the invention is to provide a counterweight arrangement which avoids the need to fill the tires with calcium chloride or any other counterweighting material. Yet another object of the invention is to provide a simple and efficient arrangement for providing the desired amount of counterweight to such a vehicle without significantly increasing the cost of the vehicle.

One aspect of the invention contemplates an improvement in a lift type vehicle having a chassis, a ground-engaging wheel arrangement carried by the chassis, an upright arrangement located on one side of the wheel arrangement and a boom assembly pivotably mounted to the upright arrangement for lifting a load on a side of the wheel arrangement opposite the upright arrangement. In accordance with this aspect of the invention, a first counterweight is associated with the upright arrangement for providing the vehicle with a first lifting capacity. A counterweight compartment is carried by the chassis and located on the same side of the wheel arrangement as the upright arrangement. A second counterweight is adapted for placement in the counterweight compartment for providing the vehicle with a second lifting capacity greater than the first lifting capacity. A third counterweight, having a weight greater than that of the second counterweight, is adapted for placement in the counterweight compartment for providing the vehicle with a third lifting capacity greater than the second lifting capacity. The upright arrangement is preferably in the form of a pair of spaced uprights, and the boom assembly is pivotably mounted to and between the pair of spaced uprights. Each upright is preferably in the form of a pair of spaced plates, and the first counterweight is in the form of a weighted filler member located between the pair of spaced plates. The counterweight compartment is preferably located between the pair of spaced uprights, and a door is preferably mounted to one of the uprights for selectively enclosing the counterweight compartment. The third counterweight preferably includes the second counterweight and at least one additional weighted member secured to the second counterweight for providing a weight to the third counterweight greater than that of the second counterweight. A retainer arrangement is preferably provided for securing the second and third counterweights in position within the counterweight compartment. In a preferred form, the counterweight compartment includes a floor for supporting the second and third counterweights, and the retainer arrangement is in the form of a bolt engageable with the floor and with the second and third counterweights for securing the second and third counterweights to the floor of the counterweight compartment.

Another aspect of the invention involves a counterweight system for a lift type vehicle having a chassis, a ground-engaging wheel arrangement carried by the chassis, and a lift mechanism mounted to the chassis. In accordance with this aspect of the invention, a counterweight compartment is carried by the chassis and located on a side of the wheel arrangement opposite the lift mechanism. The counterweight compartment is configured to receive two or more counterweights having different weights. A first one of the counterweights provides a first lifting capacity for the vehicle, and a second one of the counterweights provides a second lifting capacity different than the first lifting capacity. The lift mechanism is preferably in the form of an extendible boom assembly which is mounted to the chassis via a pair of uprights carried by the chassis on one side of the wheel arrangement, and extends to an opposite side of the wheel arrangement for lifting a load. The counterweight compartment is located on the same side of the wheel arrangement as the uprights, and is preferably disposed between the uprights. A second compartment may be located between the pair of uprights adjacent the counterweight compartment for housing certain components of the vehicle, and a door selectively encloses both the counterweight compartment and the second compartment. As summarized previously, the first counterweight is in the form of a first weighted member adapted to be received within the counterweight compartment, and the second counterweight is in the form of the first weighted member together with at least one additional weighted member adapted to be received within the counterweight compartment along with the first weighted member.

Another aspect of the invention contemplates a method of providing a lift type vehicle with a desired lifting capacity. The vehicle includes the same general components as summarized above, and the method involves providing the chassis with a counterweight-receiving area on the same side of the wheel arrangement as the upright arrangement, and providing first and second counterweights, with the second counterweight having a weight greater than that of the first counterweight. The method further involves positioning either the first or the second counterweight in the counterweight receiving area. Positioning the first counterweight in the counterweight receiving area provides the vehicle with a first lifting capacity, and positioning the second counterweight in the counterweight receiving area provides the vehicle with a second lifting capacity greater than the first lifting capacity. The counterweight receiving area is preferably in the form of a counterweight compartment as summarized above positioned between the pair of spaced supports, and is configured to receive and retain either the first or the second counterweight therein. Again, other details of this aspect of the invention are generally as set forth above.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
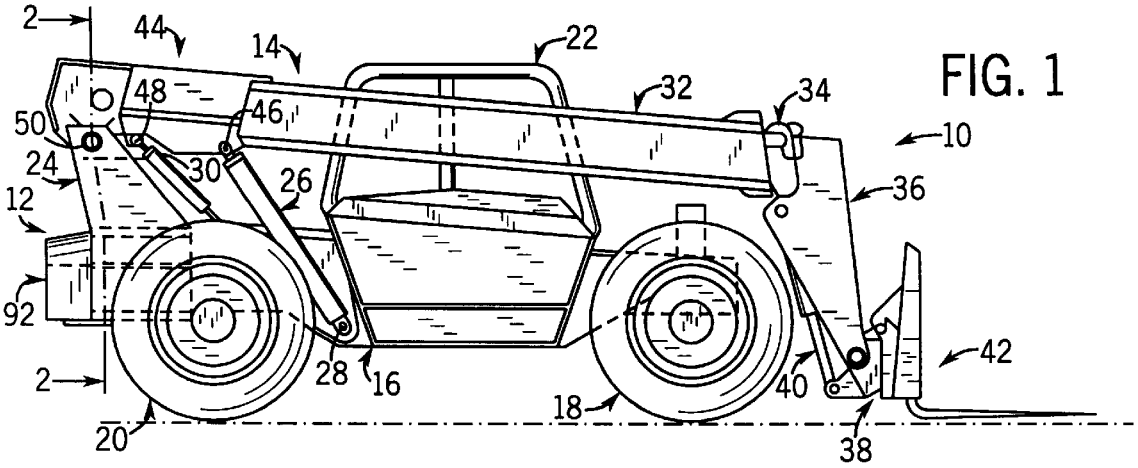
FIG. 1 is a side elevation view of an extendible boom lift type vehicle incorporating the counterweight system of the present invention.

Referring to FIG. 1, an extendible boom forklift 10 generally includes a chassis 12 and a boom assembly 14 mounted to chassis 12. Chassis 12 includes a frame 16, a pair of front ground-engaging wheels 18 mounted toward the forward end of frame 16, and a pair of rear ground-engaging wheels 20 mounted toward the rearward end of frame 16. A cab 22 is mounted to frame 16 between front wheels 28 and rear wheels 30, and a pair of uprights 24 are mounted to frame 16 toward its rearward end, rearwardly of cab 32 and wheels 30. A pair of lift cylinders 26 are located one on either side of frame 16, and each lift cylinder 26 is connected to frame 16 via a pivot connection 28 which pivotably secures the cylinder end of lift cylinder 26 to frame 16 for movement about a substantially horizontal pivot axis. A pair of slave cylinders 30 are also located one on either side of frame 16, and the cylinder end of each slave cylinder 30 is connected to frame 16 via a pivot connection which provides pivoting movement of cylinder 30 about a substantially horizontal pivot axis.

Boom assembly 14 generally includes an outer boom member 32 and an intermediate boom member 34 which is received within an internal passage defined by outer boom member 32 for telescoping inward and outward telescoping movement relative to outer boom member 32. Boom assembly 14 further includes an inner boom member received within an internal passage defined by intermediate boom member 34 and mounted for axial inward and outward telescoping movement relative to intermediate boom member 34. A nose section 36 is mounted to the forward end of the inner boom member, and is located forwardly of the forward end of chassis 12. A drive arrangement provides inward and outward movement of intermediate boom member 34 and the inner boom member to which nose section 36 is mounted, in a manner as is known.

A tool mounting assembly 38 is pivotably mounted to the lower end of nose section 36, and a tilt cylinder 40 is interposed between nose section 36 and tool mounting assembly 38. Tool mounting assembly 38 includes an arrangement for releasably engaging a tool with boom assembly 14 through nose section 36. As shown in the drawings, the tool is in the form of a fork assembly 42, although it is understood that any other tool as desired can be mounted to tool mounting assembly 38.

Figure 2:
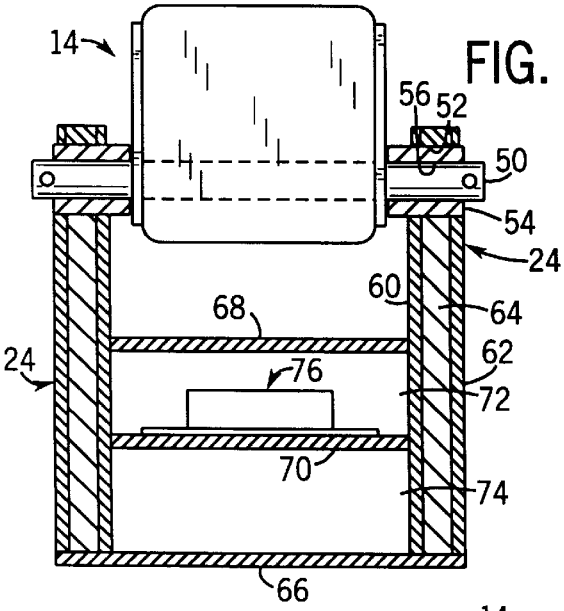
FIG. 2 is a section view taken along line 2—2 of FIG. 1, showing a configuration in which the counterweight compartment is empty.

Boom assembly 14 includes a mounting structure 44 toward its rearward end. Lift cylinder 26 is engaged with mounting structure 44 via a pivot connection 46, and slave cylinder 30 is connected to mounting structure 44 via a pivot connection 48. A pivot shaft 50 is operable to pivotably mount boom assembly 14 to uprights 24. As shown in FIG. 2, a horizontal passage 52 is formed in each upright 24, and a bearing 54 is mounted within each passage 52. Bearings 54 are in alignment with each other, and define aligned internal passages 56. Boom assembly 14 is received within a space between the facing inner ends of bearings 54, and pivot shaft 50 extends through aligned bearing passages 56 and a horizontal passage formed in boom assembly mounting structure 44, so as to pivotably mount boom assembly 14 to and between the upper ends of uprights 24. Boom assembly 14 is pivotable about a pivot axis defined by the longitudinal axis of pivot shaft 50.

With the arrangement as described above, boom assembly 14 is operable to lift a load located forwardly of chassis 12 utilizing the tool, such as fork assembly 42, mounted to the forward end of boom assembly 14 forwardly of front wheels 18. Extension of lift cylinders 26 functions to pivot boom assembly 14 about pivot shaft 50 in a counterclockwise direction to lift a load carried by the tool, such as fork assembly 42, and likewise retraction of cylinders 26 functions to lower the load by allowing boom assembly 14 to pivot in a clockwise direction about pivot shaft 50. Uprights 24 are located rearwardly of the axle through which rear wheels 20 are mounted to frame 16, as is the pivotable connection of boom assembly 14 to uprights 24 through pivot shaft 50.

FIGS. 2–7 illustrate the rearward end of chassis 12, including uprights 24 mounted to the rear of frame 16 and to which boom assembly 14 is mounted. Uprights 24 are constructed to provide a counterweight for chassis 12 to resist the tendency of chassis 12 to tip when a load is supported at the forward end of boom assembly 14, such as on fork assembly 42. Each upright 24 includes an inner plate 60 and an outer plate 62, in combination with a weighted filler member 64 sandwiched between inner plate 60 and outer plate 62. Inner plate 60, outer plate 62 and weighted filler 64 have approximately the same shape, and are interconnected together such as by welding along the outer edges of plates 60, 62 and filler member 64, so as to form a unitary construction for each upright 24.

Figure 7:
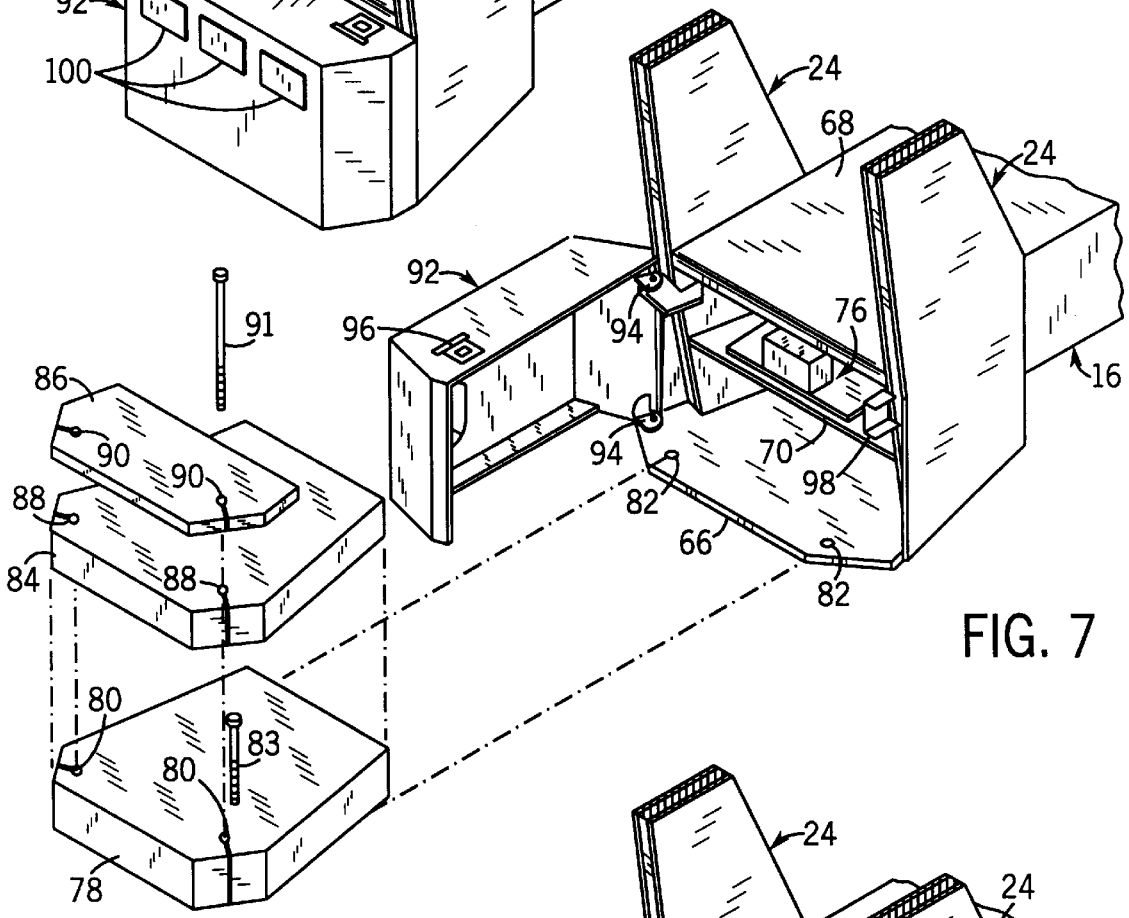
FIG. 7 is an exploded isometric view showing the rear of the chassis as in FIGS. 5 and 6 and the counterweight members which are adapted to be received within the counterweight compartment.

Uprights 24 are spaced apart from each other, and boom assembly 14 is disposed between uprights 24 at the upper extent of the space between uprights 24. A floor plate 66 is connected to the lower end of each upright 24, extending across the lower extent of the space between uprights 24. As shown in FIG. 7, floor plate 66 extends rearwardly of the rearward end of each upright 24, to form an upwardly facing platform between uprights 24.

Frame 16 defines an upper wall 68 spaced above floor plate 66 and connected at each edge to inner plate 60 of one of uprights 24. An intermediate transverse wall 70 is connected along each of its side edges to inner plate 60 of one of uprights 24, and functions to form an upper compartment 72 and a lower compartment 74 between floor plate 66 and frame upper wall 68.

A hydraulic control valve assembly 76 is mounted to the upwardly facing surface of intermediate transverse wall 70 within upper compartment 72. Hydraulic control valve assembly 76 is interconnected with the hydraulic components of vehicle 10, such as lift cylinder 26, slave cylinder 30 and tilt cylinder 40, to control operation of such components in response to operation of controls within cab 22 by the operator.

Figure 3:
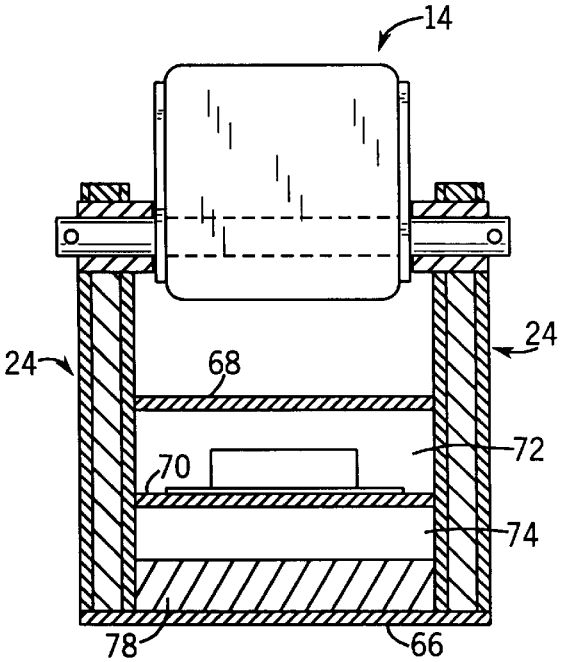
FIG. 3 is a view similar to FIG. 2, showing a configuration in which a first counterweight is positioned in the counterweight compartment to increase the lifting capacity of the vehicle.
Figure 4:
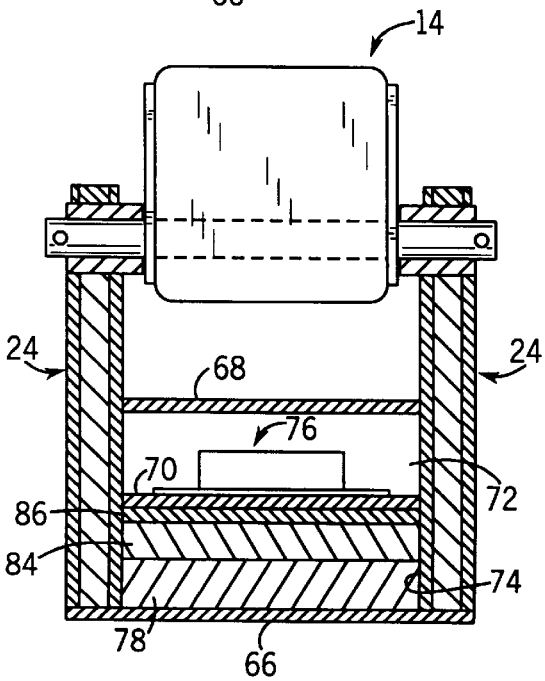
FIG. 4 is a view similar to FIGS. 2 and 3, showing additional weighted members received within the counterweight compartment for further increasing the lifting capacity of the vehicle.

Lower compartment 74 makes up a counterweight compartment or counterweight-receiving area for receiving additional counterweights to increase the lifting capacity of vehicle 10, if desired. As shown in FIG. 2, counterweight compartment 74 is empty and counterweighting of vehicle 10 is provided by the weighted uprights 24 as described above. To increase the lifting capacity of vehicle 10, a first weighted member or counterweight 78 is received within counterweight compartment 74, as shown in FIG. 3. Counterweight 78 has a shape in plan which roughly corresponds to that of floor 66. Counterweight 78 defines tapered side edges adapted for placement adjacent the facing edges of uprights 24, and the inner edge of counterweight 78 is located adjacent an end wall of counterweight compartment 74. The rear edge of counterweight 78 is supported by the platform portion of floor 66 extending rearwardly of uprights 24. Counterweight 78 is made of a dense metal material, and functions to increase the counterweight at the rear end of vehicle 10 by a first increment to increase the lifting capacity for vehicle 10.

Counterweight 78 includes a pair of vertical passages 80, which are in alignment with openings 82 formed in floor 66 when counterweight 78 is placed on floor 66. A bolt 83 extends through each passage 80 and its aligned opening 82, and is tightened down so as to secure counterweight 78 in position within counterweight compartment 74.

Figure 6:
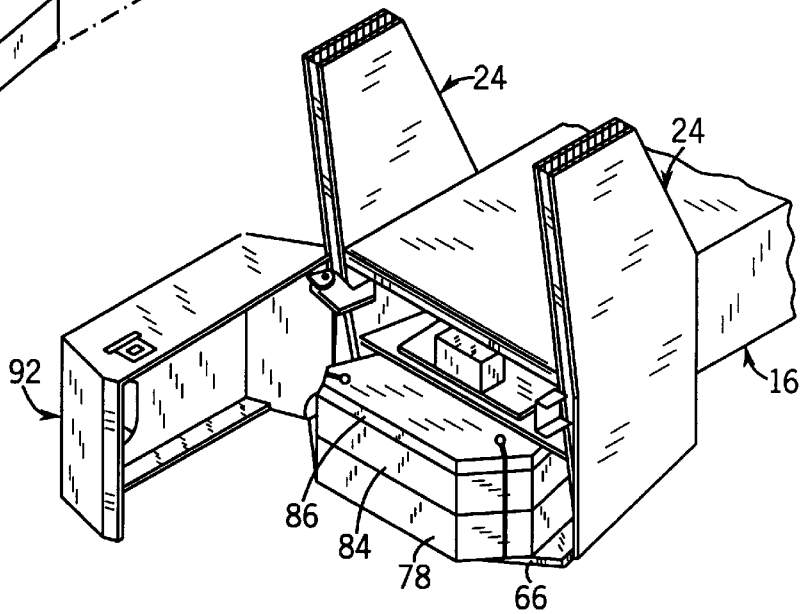
FIG. 6 is a view similar to FIG. 5, showing a door at the rear end of the chassis opened to expose the counterweight compartment.

To further increase the lifting capacity of vehicle 10, a second weighted member or counterweight 84 is placed in counterweight compartment 74 above counterweight 78. A third weighted member or counterweight 86 overlies the rearward portion of counterweight 84, and the configuration of counterweights 84 and 86 conforms to the available space within counterweight compartment 74. Counterweights 84 and 86 are also formed of a dense metal material, and function to increase the counterweighting of vehicle 10 by a second increment to provide a like increase in the lifting capacity of vehicle 10. Again, counterweights 84 and 86 are provided with aligned passages 88 and 90, respectively. Each passage 88, 90 is placed in alignment with one of passages 80 and openings 82, and a bolt 91 is placed through aligned passage 80, 88 and 90 and opening 92 so as to secure counterweights 78, 84 and 86 to floor 66 as a unit, as illustrated in FIG. 6.

It can thus be appreciated that counterweight 78 provides a first incremental addition to the counterweighting of vehicle 10 to increase the lifting capacity by a predetermined amount, and the combination of counterweight 78 with counterweights 84 and 86 form a second counterweight having a weight greater than the first counterweight, namely counterweight 78, so as to provide an additional increase in the lifting capacity of vehicle 10.

Figure 5:
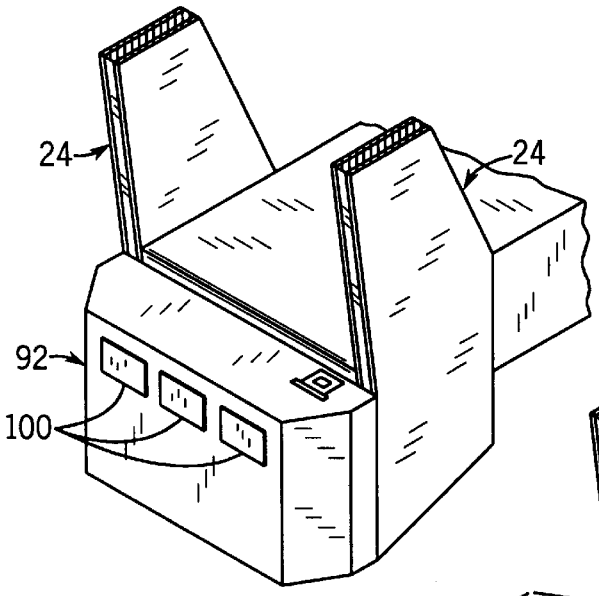
FIG. 5 is a partial isometric view showing the rear end of a chassis for the vehicle of FIG. 1.

A door 92 is connected to one of uprights 24 via a pair of hinges 94. Door 92 includes a latch 96, and a catch 98 is mounted to the upright 24 opposite the upright 24 to which door 92 is hingedly mounted. Door 92 is movable between a closed position as shown in FIG. 5 and an open position as shown in FIGS. 6 and 7, so as to selectively enclose counterweight compartment 74 and upper compartment 72. A set of tail lights 100 are mounted to the rear panel of door 92. With this arrangement, the counterweights for vehicle 10, when received within counterweight compartment 74, are concealed so as to improve the aesthetic appearance of vehicle 10 and so as to enable tail lights 100 to be mounted to the rear of vehicle 10 in a location which, in the prior art, was occupied by a counterweight.

The weighting of uprights 24, in combination with the provision of counterweight compartment 74 and its ability to receive one or two counterweights, provides a simple and efficient arrangement for providing vehicle 10 with the desired amount of counterweight according to the capacity of the other components of vehicle 10. Further, the counterweighting provided by uprights 24, in combination with counterweights 78, 84 and 86, provides the ability to attain sufficient counterweight for the maximum lifting capacity for vehicle 10 without the need to fill the rear tires with weighted material, such as calcium chloride or the like. In addition, counterweights received in compartment 74 are engaged with and supported by floor 66, which eliminates the need to hang or suspend counterweights from the rear of the uprights.

Various alternatives and embodiments are contemplated as being within the scope of the following claims particularly pointing out and distinctly claiming the subject matter regarded as the invention.

I claim:

1. In a lift type vehicle having a chassis, a ground-engaging wheel arrangement carried by the chassis, an upright arrangement located on one side of the wheel arrangement, and a boom assembly pivotably mounted to the upright arrangement for lifting a load on a side of the wheel arrangement opposite the upright arrangement, the improvement comprising:

a first counterweight associated with the upright arrangement for providing the vehicle with a first lifting capacity;

a counterweight compartment carried by the chassis and located on the same side of the wheel arrangement as the upright arrangement;

a second counterweight adapted for placement in the counterweight compartment for providing the vehicle with a second lifting capacity greater than the first lifting capacity; and a third counterweight having a weight greater than that of the second counterweight and adapted for placement in the counterweight compartment for providing the vehicle with a third lifting capacity greater than the second lifting capacity.

2. The improvement of claim 1, wherein the upright arrangement comprises a pair of spaced uprights, wherein the boom assembly is pivotably mounted to and between the pair of spaced uprights, and wherein each upright comprises a pair of spaced plates and a weighted filler member located between the pair of spaced plates.

3. The improvement of claim 1, wherein the upright arrangement comprises a pair of spaced uprights, and wherein the counterweight compartment is located between the pair of spaced uprights.

4. The improvement of claim 3, further comprising a door for enclosing the counterweight compartment.

5. The improvement of claim 1, wherein the third counterweight includes the second counterweight in combination with at least one additional weighted member for providing a weight to the third counterweight greater than that of the second counterweight.

6. The improvement of claim 1, further comprising a retainer arrangement for securing the second and third counterweights in position within the counterweight compartment.

7. The improvement of claim 6, wherein the counterweight compartment includes a floor for supporting the second and third counterweights, and wherein the retainer arrangement is operable to secure the second and third counterweights to the floor of the counterweight compartment.

8. The improvement of claim 7, wherein the retainer arrangement comprises a bolt engageable with the floor of the counterweight compartment and with the second and third counterweights.

9. A counterweight system for a lift type vehicle having a chassis, a ground-engaging wheel arrangement carried by the chassis, and a lift mechanism mounted to the chassis, comprising:

a counterweight compartment carried by the chassis and located on a side of the wheel arrangement opposite the lift mechanism, wherein the lift mechanism is mounted to the chassis via a pair of uprights carried by the chassis on one side of the wheel arrangement, wherein the lift mechanism extends to an opposite side of the wheel arrangement for lifting a load, and wherein the counterweight compartment is located on the same side of the wheel arrangement as the uprights and is disposed between the uprights; and two or more counterweights having different weights, wherein the counterweight compartment is configured to receive a first one of the counterweights to provide a first lifting capacity for the vehicle, and a second one of the counterweights to provide a second lifting capacity for the vehicle different than the first lifting capacity.

10. The counterweight system of claim 9, wherein the counterweight compartment includes a floor extending between the pair of uprights and interconnected with a lower end portion defined by each upright.

11. The counterweight system of claim 10, further comprising a retainer arrangement for securing either the first or the second counterweight to the floor of the counterweight compartment.

12. The counterweight system of claim 9, further comprising a second compartment located between the pair of spaced uprights and adjacent the counterweight compartment.

13. The counterweight system of claim 12, further comprising a door for selectively enclosing the counterweight compartment and the second compartment.

14. The counterweight system of claim 9, wherein the first one of the counterweights comprises a first weighted member adapted to be received within the counterweight compartment and wherein the second one of the counterweights comprises the first weighted member together with at least one additional weighted member adapted to be received within the counterweight compartment along with the first weighted member.

15. A method of providing a lift type vehicle with a desired lifting capacity, wherein the vehicle includes a chassis, a ground-engaging wheel arrangement carried by the chassis, an upright arrangement located on one side of the wheel arrangement, and a boom assembly pivotably mounted to the upright arrangement for lifting a load on a side of the wheel arrangement opposite the upright arrangement, comprising the steps of:

providing the chassis with a counterweight receiving area on the same side of the wheel arrangement as the upright arrangement;

providing a first counterweight;

providing a second counterweight having a weight greater than that of the first counterweight; and positioning either the first or the second counterweight in the counterweight receiving area, wherein positioning of the first counterweight in the counterweight receiving area provides the vehicle with a first lifting capacity and wherein positioning of the second counterweight in the counterweight receiving area provides the vehicle with a second lifting capacity greater than the first lifting capacity, wherein the counterweight receiving area is configured to receive and retain either the first or the second counterweight therein.

16. The method of claim 15, wherein the upright arrangement comprises a pair of spaced uprights, and wherein the step of providing the chassis with a counterweight receiving area comprises positioning a counterweight compartment between the pair of spaced uprights.

17. The method of claim 16, wherein the step of providing a first counterweight is carried out by providing a first weighted member and wherein the step of providing a second counterweight is carried out by providing the first weighted member and one or more additional weighted members.

18. The method of claim 17, wherein the step of positioning either the first or the second counterweight in the counterweight receiving area is carried out by securing either the first weighted member alone or the first weighted member in combination with the one or more additional weighted members to a floor defined by the counterweight compartment.

19. The method of claim 16, further comprising the step of movably mounting a door over the counterweight compartment for selectively enclosing the counterweight compartment.

20. The method of claim 19, further comprising the step of providing an additional compartment adjacent the counterweight compartment, and wherein the door is configured to selectively enclose both the counterweight compartment and the additional compartment.

* * * * *